US006550375B2

(12) United States Patent
Cheung

(10) Patent No.: US 6,550,375 B2
(45) Date of Patent: Apr. 22, 2003

(54) STRAPPER WITH FEED WHEEL CLEANING DEVICE

(75) Inventor: Nelson Cheung, Hoffman Estates, IL (US)

(73) Assignee: Illinois Tool Works Inc, Glenview, IL (US)

( * ) Notice: Subject to any disclaimer, the term of this patent is extended or adjusted under 35 U.S.C. 154(b) by 55 days.

(21) Appl. No.: 09/812,164

(22) Filed: Mar. 19, 2001

(65) Prior Publication Data

US 2002/0129716 A1 Sep. 19, 2002

(51) Int. Cl.[7] ..... B65B 13/24
(52) U.S. Cl. ..... 100/29; 15/256.51
(58) Field of Search ..... 100/29, 32, 102; 15/256.5, 256.51

(56) References Cited

U.S. PATENT DOCUMENTS 3,284,049 A * 11/1966 Haraden ..... 112/322
3,944,460 A * 3/1976 Karr ..... 100/33 PB
5,181,546 A * 1/1993 Synek ..... 140/152
6,073,294 A * 6/2000 Mashtare et al. ..... 15/1.51

* cited by examiner

*Primary Examiner*—Allen Ostrager
*Assistant Examiner*—Shelley Self
(74) *Attorney, Agent, or Firm*—Donald J. Breh; Mark W. Croll; Lisa M. Soltis

(57) ABSTRACT

A strapping tool includes an integral, removable cleaning element. The strapping tool forms a seal between two portions of associated strapping material, which strapping material is tensioned by a feed wheel prior to forming the seal. The tool includes a strapping machine body, a subassembly operably coupled to the strapping machine body. A feed wheel is carried by the subassembly and is rotatable within the subassembly. A feed lever is operably connected to the subassembly and to the feed wheel for rotating the feed wheel. A cleaning element is supported by the subassembly and is disposed for continuous contact with the rotating feed wheel.

12 Claims, 2 Drawing Sheets

STRAPPER WITH FEED WHEEL CLEANING DEVICE

BACKGROUND OF THE INVENTION

The present invention relates to a cleaning device for cleaning the feed wheel of a strapping machine. More particularly, the present invention relates to a readily replaceable cleaning brush for cleaning the feed wheel of a strapping machine, which cleaning brush is in place during operation of the strapping machine.

Strapping machines or strappers are well known in the art. These machines are used for strapping articles together with strapping material. Strapping material is offered in a variety of sizes and materials and is generally stored on a roll. Conventional strapping materials include steel and plastic.

Typically, a free end of strapping material is passed around the articles until there is an overlap between the free end and the strapping material still connected to the roll. The overlapping portion of strapping material is placed between jaws of a strapping machine and the free end of the strapping material is fixed in place by a gripper portion and feed wheel of the machine. After the strapping material is fixed, the material is tightened or tensioned around the load to a desired tension. This is accomplished by operating a feed lever that rotates a feed wheel to pull back or tension the strapping material. A typical feed wheel includes serrations or grooves formed in the surface of the wheel to increase the friction developed between the wheel and the strap.

A typical strapping machine includes sealing heads for sealing the free end of the strapping material onto itself, around the load. Typically, in manual (i.e., hand-operated) strapping machines, a handle is rotated which applies a force to cause a punch or sealing head to press down against the strap to seal the strap to itself. After the strapping material is sealed, the strapping material still connected to the roll is cut by a cutter of the strapping machine. This completes one strapping operation. This type of seal, which is effected by sealing the strap to itself, differs from those strappers that position a separate piece of material around the tensioned strap.

Typically, steel strapping is provided with a coating, such as epoxy or paint. In that the bare strapping is often formed from common carbon steel materials, the coating prevents corrosion which could, if left unabated, compromise the integrity of the strap.

During the tensioning operation, when the feed wheel contacts and "pulls" the strap, a portion of the coating can be removed (e.g., ground) from the strap. This coating debris can become lodged in the feed wheel serrations or grooves thus reducing the friction developed between the wheel and the strap.

In addition, other dirt or debris can accumulate on the feed wheel while tightening or tensioning the strap. The accumulated debris may 'clog up' the feed wheel, necessitating feed wheel maintenance, which may be time consuming and expensive.

Accordingly, there exists a need for a feed wheel cleaning arrangement that is effectively used with a strapping machine feed wheel as the strap is tensioned around the load. Desirably, such a feed wheel cleaning arrangement readily removes accumulated dirt or debris from the feed wheel so that an acceptable amount of friction can be developed between the feed wheel and the strap. Most desirably, such a cleaning arrangement is in place during strapping machine operation and is readily replaced as necessary.

SUMMARY OF THE INVENTION

A strapping tool forms a seal between two portions of associated strapping material, which strapping material is tensioned prior to forming the seal. The tool includes a strapping machine body and a subassembly operably coupled to the body. A feed wheel is carried by the subassembly and is rotatable within the subassembly. The strapping material is tensioned by engagement of the rotating feed wheel with the strapping material. A feed lever is operably connected to the subassembly and to the feed wheel for rotating the feed wheel.

A cleaning element is supported by the subassembly. The cleaning element is disposed for continuous contact with the rotating feed wheel. In a current embodiment, the cleaning element includes a brush portion and a handle portion. Preferably, the handle portion is formed from a flexible wire. The cleaning element is configured to be readily removed, e.g., pulled by the handle, from the strapping tool for replacement.

A present strapping tool subassembly includes a pair of spaced apart, opposing walls with the feed wheel positioned between the walls. Each wall includes an opening therein at a periphery of the feed wheel. The cleaning element is disposed within the subassembly, in the openings with the brush portion in contact with the feed wheel. In this manner, the brush portion remains in contact with the feed wheel during strapping tool operation.

In a present strapping tool, the feed wheel is configured to rotate counter-clockwise and the cleaning element is positioned along an anterior side of the feed wheel. Alternately, the feed wheel can be configured to rotate clockwise and the cleaning element can be positioned along a posterior side of the feed wheel.

Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
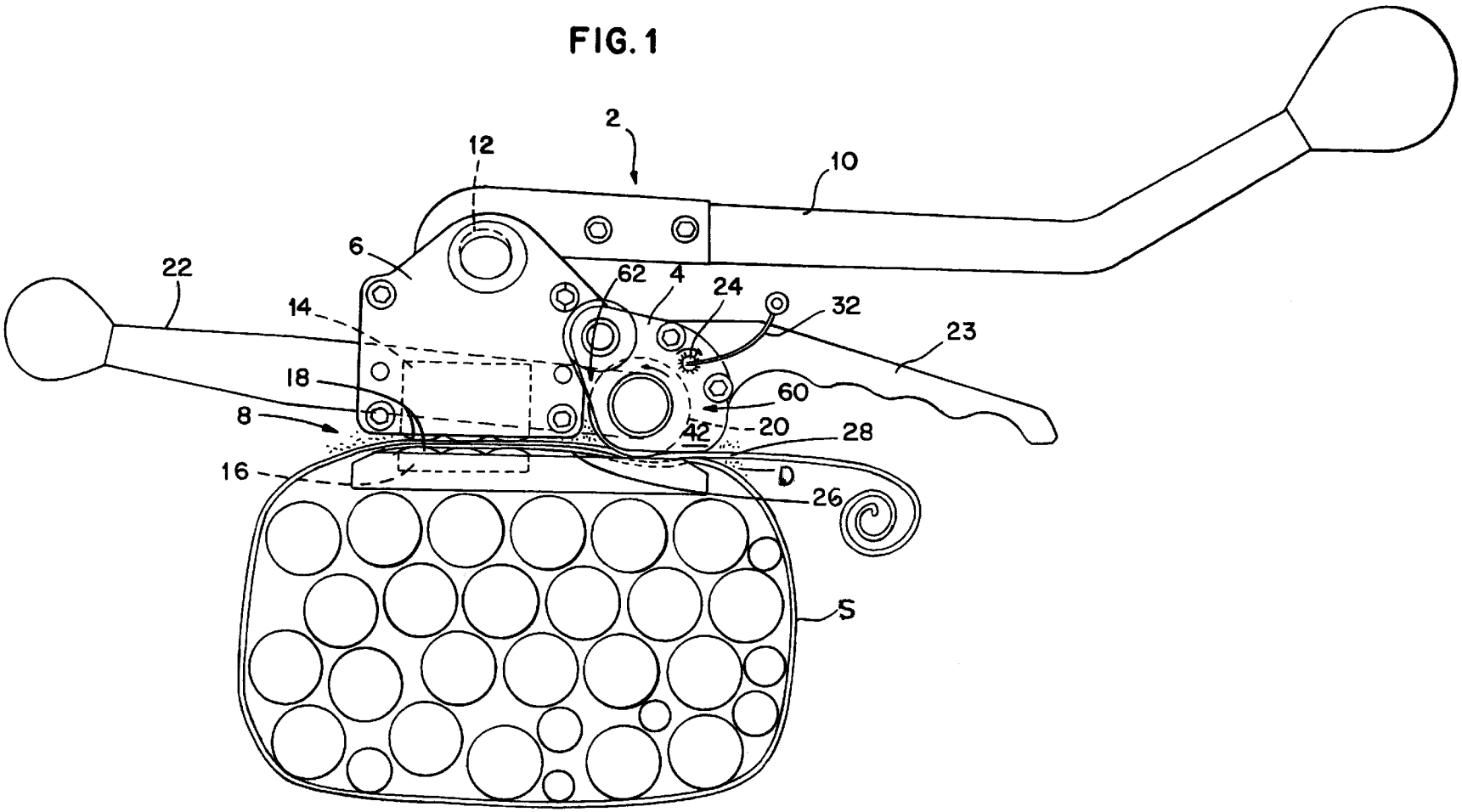
FIG. 1 illustrates an exemplary strapping machine having a cleaning device embodying the principles of the present invention; and, FIG. 2 illustrates a side view of a configuration including a feed wheel, a subassembly, and the cleaning device of FIG. 1 embodying principles of the present invention.

While the present invention is susceptible of embodiment in various forms, there is shown in the drawings and will hereinafter be described a specific embodiment with the understanding that the present disclosure is to be considered an exemplification of the invention and is not intended to limit the invention to the specific embodiment illustrated. It should be further understood that the title of this section, normally, "Detailed Description of the Invention," relates to a requirement of the United States Patent and Trademark Office, and does not imply, nor should be referred to limit the subject matter disclosed and claimed herein.

The invention may be used in a variety of strapping machines or tools (also referred to as strappers) such as the exemplary strapper 2 illustrated in FIG. 1, the construction and operation of which will be readily recognized by those skilled in the art. The illustrated strapper 2 includes a subassembly 4 operably coupled to a strapping machine body 6. A cutter (not shown), a gripper (not shown), and a jaw assembly 8 are positioned within the strapping machine body 6. An accompanying actuating lever 10, which is configured to rotate about an eccentric shaft 12, actuates the cutter and jaw assembly 8. The jaw assembly 8 includes a first, movable support 14 and a second, fixed support 16. Sealing elements 18 are carried by the supports 14, 16 for forming a seal in the strap S.

A feed wheel 20 and cleaning element 24 are positioned within the subassembly 4. The feed wheel 20 is actuated by rotating a feed lever 22. Those skilled in the art will recognize and appreciate the various strapping machine configurations, which may include grippers, feed wheels and/or accompanying levers and cutters of various types, or other structures used to grip a strap, tension a strap around a load and cut the strap, with which the present cleaning element 24 can be used.

In use of the strapper 2 of FIG. 1, typically, a first or free end of the strapping material S is passed around a load L and fed between the movable and fixed supports 14, 16. The free end of the strap S is gripped by the gripper, which results in an overlap of strapping material S, with the free end forming a lower layer 26 of strapping material S. An upper layer 28 of strap S overlaps the lower layer 26. The feed lever 22 is then operated (e.g., rotated) which in turn rotates the feed wheel 20, tightening the strap S around the load. In the illustrated strapper 2, when the feed lever 22 is actuated the entire subassembly 4 pivots and the feed wheel 20 rotates to tension the strap S. The strap S is then sealed to itself, and cut. A handle 23 can be used to hold the strapper 2 when actuating the feed lever 22.

As set forth above, many known strap materials are provided with a corrosion-resistant coating. The coating may rub off of the strap or may be ground off of the strap by the engagement of the wheel 20 and strap S, causing debris. To this end, when tightening the strap S around the load L, coating debris as well as other dirt and debris, generally indicated as D, can accumulate on the feed wheel 20. Desirably, this dirt and debris D is cleaned from the wheel 20 to ensure efficient feed wheel 20 operation. The present cleaning element 24 allows feed wheel 20 cleaning without timely or costly maintenance.

Figure 2:
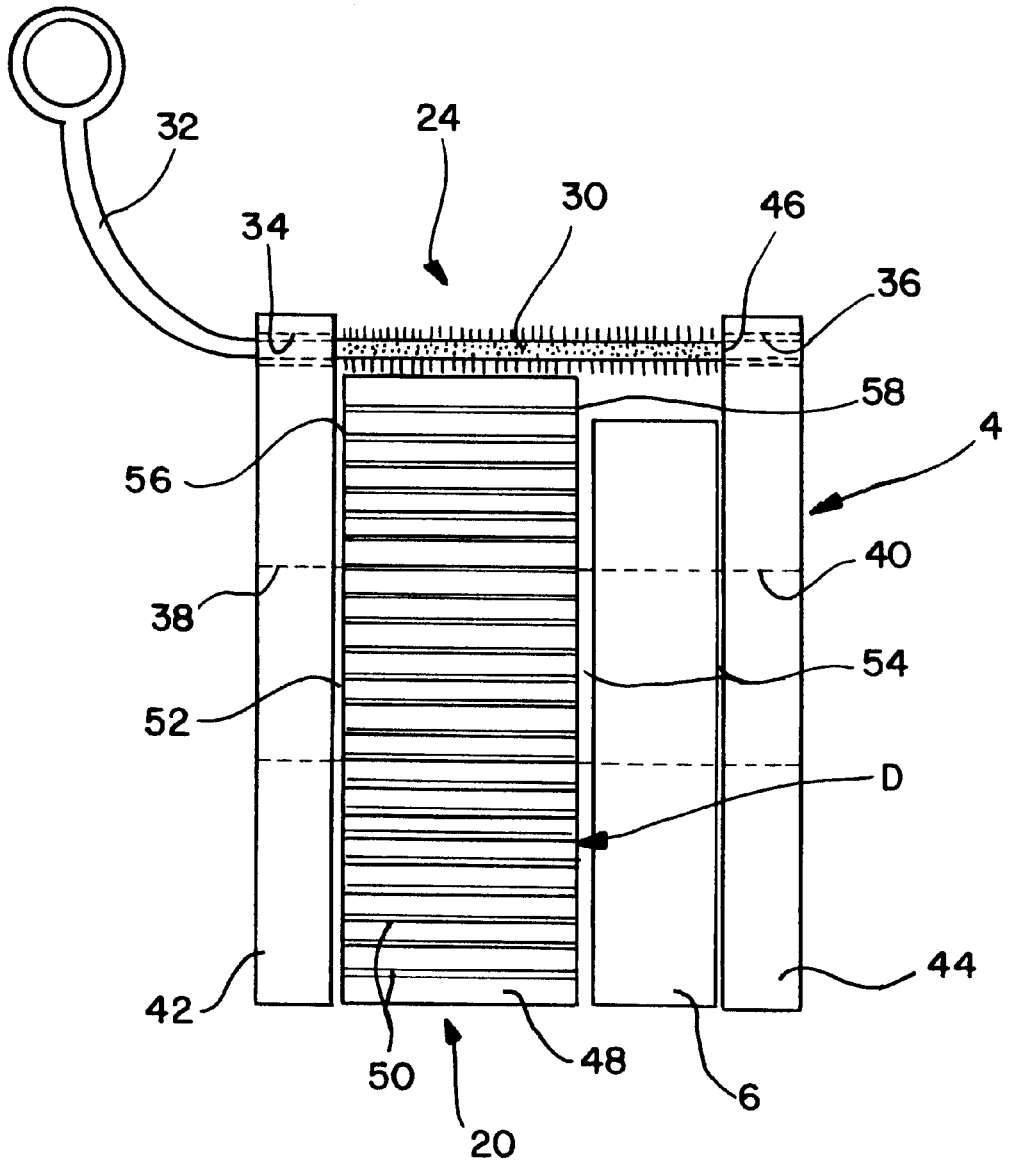

Referring to FIG. 2, the cleaning element 24 includes a brush portion 30 integral with a flexible wire handle 32. Openings 34, 36 are formed in the walls 42, 44 of the subassembly 4. A first end 46 of the element 24 is inserted into and through opening 34 and is urged wall 42. The element 24 is further urged through opening 36 in wall 44. The cleaning element 24 is readily removed by pulling on the handle 32 until is it free of walls 42, 44.

Those skilled in the art will recognize that the cleaning element 24 may be attached to the subassembly 4, by, for example, using a brush that has first and second shafts formed on both sides of the brush, and positioning the shafts within shaft apertures formed within internal sides of the subassembly walls 42, 44. In such an embodiment, the cleaning element 24 may not be as readily removable.

The feed wheel 20 of FIG. 2 includes a main body portion 48 with grooves or serrations, indicated at 50 formed thereon. The wheel is mounted to the subassembly by a shaft having shaft portions 52, 54 extending from the wheel 20 that are positioned in the shaft apertures 38, 40 in the subassembly 4 to allow for the feed wheel 20 to rotate upon actuation by the feed lever 22 (FIG. 1).

Preferably, as shown in FIG. 1, the cleaning element 24 is positioned along a posterior side of and above (as indicated generally at 60) the feed wheel 20. In this manner, as the cleaning element 24 contacts the feed wheel 20 (which rotates in a counterclockwise direction), the brush 30 directs dust and debris D away from the feed wheel 20. Those skilled in the art will recognize that the cleaning element 24 can be positioned along an anterior side (as indicated generally at 62) of the feed wheel 20, and will have the same result for feed wheels that are configured to rotate in a clockwise direction.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. A strapping tool for forming a seal between two portions of associated strapping material, the strapping material being tensioned prior to forming the seal, the tool comprising:

a strapping machine body;

a subassembly operably coupled to the strapping machine body;

a feed wheel carried by the subassembly, the feed wheel being rotatable within the subassembly;

a feed lever operably connected to the subassembly and to the feed wheel for rotating the feed wheel, wherein the strapping material is tensioned by engagement of the rotating feed wheel with the strapping material; and a cleaning element supported by the subassembly, wherein the cleaning element is disposed for continuous contact with the rotating feed wheel.

2. The strapping tool in accordance with claim 1 wherein the cleaning device includes a brush portion and a handle portion.

3. The strapping tool in accordance with claim 2 wherein the handle portion is formed from a flexible wire.

4. The strapping tool in accordance with claim 2 wherein the subassembly includes a pair of spaced apart, opposing walls with the feed wheel positioned between the walls, and wherein each wall include an opening therein at a periphery of the feed wheel and wherein the cleaning element is disposed within the subassembly, in the openings with the brush portion in contact with the feed wheel.

5. The strapping tool in accordance with claim 1 wherein the cleaning element is a removable subassembly.

6. The strapping tool in accordance with claim 1 wherein the feed wheel is configured to rotate clockwise and the cleaning element is positioned along an anterior side of the feed wheel.

7. The strapping tool in accordance with claim 1 wherein the feed wheel is configured to rotate counter-clockwise and the cleaning element is positioned along a posterior side of the feed wheel.

8. A strapping tool for forming a seal between two portions of associated strapping material, the strapping tool material being tensioned prior to forming the seal, the strapping tool comprising:

a strapping machine body;

a cleaning element supported by the strapping machine body;

a feed wheel; and, a feed lever, the feed wheel being operably connected to the feed lever, the feed lever configured to have a first vertical position and a second vertical position in which the feed wheel engages the strapping material to exert a tension in the strapping material, wherein the feed wheel engages the cleaning element when the feed lever is in the second vertical position.

9. The strapping tool in accordance with claim 8, wherein the cleaning element includes a brush portion and a handle portion, the handle portion being a flexible wire.

10. The strapping tool in accordance with claim 8, wherein the feed wheel s carried between spaced apart mounting members and wherein the cleaning element is disposed in openings in the mounting members to contact the feed wheel at a periphery thereof.

11. The strapping machine in accordance with claim 8, wherein the cleaning device is positioned along an anterior side of the feed wheel when the feed wheel is configured to rotate clockwise.

12. The strapping machine in accordance with claim 8, wherein the cleaning device is positioned along a posterior side of the feed wheel when the feed wheel is configured to rotate counter-clockwise.

* * * * *